United States Patent [19]

Habib, Jr.

[11] 4,185,872

[45] Jan. 29, 1980

[54] IN-SITU LEACHING OF URANIUM

[75] Inventor: Edward T. Habib, Jr., Richardson, Tex.

[73] Assignee: Mobil Oil Corporation, New York, N.Y.

[21] Appl. No.: 934,933

[22] Filed: Aug. 18, 1978

[51] Int. Cl.[2] ..... E21B 43/28

[52] U.S. Cl. ..... 299/4; 423/3; 423/15; 423/17

[58] Field of Search ..... 299/4, 5; 423/3, 15, 423/17

[56] References Cited

U.S. PATENT DOCUMENTS

| | | | |
|---|---|---|---|
| 2,896,930 | 7/1959 | Menke | 299/5 |
| 2,954,218 | 9/1960 | Dew et al. | 299/5 |
| 3,081,149 | 3/1963 | Haas | 423/3 |
| 3,647,261 | 3/1972 | Stenger et al. | 299/4 |
| 3,819,231 | 6/1974 | Fehlner | 299/4 |

OTHER PUBLICATIONS

Merritt, R. C., The Extracive Melallurgy of Uranium, Colorado School of Mines, pp. 62, 63, 104, 105.

*Primary Examiner*—Ernest R. Purser
*Attorney, Agent, or Firm*—C. A. Huggett; William D. Jackson

[57] ABSTRACT

Process for the in-situ leaching of uranium from a subterranean ore deposit comprising introducing into the deposit an aqueous lixiviant having a pH of at least 6.0 and containing an alkali metal sulfate leaching agent. The alkali metal sulfate may be employed in combination with an alkali metal carbonate or bicarbonate with the sulfate comprising the predominant leaching agent. The lixiviant may be at a pH of at least 7.5 and contain an alkali metal sulfate leaching agent and a hypochlorite oxidizing agent.

11 Claims, No Drawings

IN-SITU LEACHING OF URANIUM

BACKGROUND OF THE INVENTION

The present invention relates to the recovery of uranium from subterranean ore deposits and more particularly to an in-situ leaching operation employing a near neutral or alkaline lixiviant in which the predominant leaching agent is an alkali metal sulfate.

In an in-situ leaching operation, a lixiviant is introduced into a subterranean uranium ore deposit through a suitable injection system. The lixiviant may be an acidic or alkaline medium which solubilizes uranium values as it traverses the ore body. The pregnant lixiviant is then withdrawn from the ore body through a production system and treated to recover uranium therefrom by suitable techniques such as solvent extraction, direct precipitation or by adsorption and elution employing an ion exchange resin.

In acid leaching operations, the most commonly employed acid is sulfuric acid. The sulfuric acid normally is present in the lixiviant in a concentration to provide a pH of 2 or less. Normally, sufficient acid is present in the injected lixiviant to provide an excess of acid over that consumed by uranium solubilization and inorganic carbonates within the formation in order to retain a relatively low pH in the pregnant lixiviant as it is withdrawn from the subterranean deposit. For example, as disclosed in Merritt, R. C., THE EXTRACTIVE METALLURGY OF URANIUM, Colorado School of Mines, Research Institute, USA (1971) at page 63, it is desirable to provide excess acid in order to prevent reprecipitation of uranium. Thus, Merritt discloses that uranium may precipitate from solution in the presence of various anions in sulfate solutions at pH's within the range of 1.3–6.0 depending upon temperature and the concentrations of various constituents in solution. For example, Merritt in Table 5-2 discloses that uranyl ions will precipitate from sulfate solutions in the presence of carbonate ions if the pH of the lixiviant is allowed to increase to a value within a range of 3.5–6.0.

The presence of carbonate materials in subterranean rock deposits containing uranium limits the use of acid lixiviants not only with respect to acid consumption by the carbonates but also due to the precipitation of reaction products such as calcium sulfate which may result in plugging of the formation. Thus, the use of an alkaline lixiviant is strongly indicated in many in-situ leaching operations, not only because of the carbonate content of the rock, but also since the alkaline lixiviants are more selective with respect to uranium dissolution than are the acid lixiviants. Alkaline lixiviants normally employ carbonate ions, added as alkali metal carbonates or bicarbonates or mixtures thereof to complex the uranium in the form of the watersoluble uranyl tricarbonate ion. Thus, U.S. Pat. No. 2,896,930 to Menke discloses in-situ leaching employing a "cold" aqueous solution of an alkali metal carbonate, e.g. sodium or potassium carbonate or bicarbonate, in a concentration of less than 50 grams per liter. Menke discloses that in order to increase the solubility of uranium in the cold leach solution it is useful to incorporate complexing agents capable of forming little-ionized complexes with uranium-bearing ions. The patentee lists a large number of such complexing agents including those which yield sulfate ions.

In many cases, the uranium in the subterranean deposit exists in the tetravalent state. Thus, it is a conventional practice in both acid and alkaline leaching to employ an oxidizing agent to ensure that the uranium is oxidized to or retained in the hexavalent state at which it is solubilized by the lixiviant. In in-situ leaching operations employing an alkaline lixiviant, the most commonly employed oxidizing agents are hydrogen peroxide as disclosed in the aforementioned patent to Menke or air as disclosed in U.S. Pat. No. 2,954,218 to Dew et al. An especially suitable oxidizing agent for use in conjunction with alkaline lixiviants in leaching refractory ores is an alkali metal or alkaline earth metal hypochlorite as disclosed in copending application Ser. No. 928,676 entitled PROCESS FOR THE IN-SITU LEACHING OF URANIUM, filed July 28, 1978 by Edward Thomas Habib, Jr. and Thomas C. Vogt, Jr.

SUMMARY OF THE INVENTION

In accordance with the present invention, there is provided a new and improved process for the recovery of uranium from a subterranean deposit by employing a near neutral or alkaline lixiviant in which an alkali metal sulfate salt is employed as the leaching agent. In carrying out the invention, there is introduced into the uraniumcontaining deposit via a suitable injection system an aqueous lixiviant having a pH of at least 6.0 and containing leaching agent comprised predominantly of an alkali metal sulfate salt. As the lixiviant traverses the subterranean uranium deposit, uranium therein is solubilized in the lixiviant. The resulting pregnant lixiviant containing uranium is then produced from the deposit via a suitable production system and then treated to recover uranium therefrom. The injected lixiviant may optionally contain a minor amount of an alkali metal carbonate or bicarbonate.

In a further embodiment of the invention, an aqueous lixiviant having a pH of at least 7.5 is injected into the deposit. This lixiviant contains an alkali metal sulfate salt and in addition an alkali metal hypochlorite. The hypochlorite oxidant functions to oxidize uranium in the deposit from the tetravalent to the hexavalent state at which the uranium is solubilized due to the presence of sulfate ion in the lixiviant.

DESCRIPTION OF THE SPECIFIC EMBODIMENTS

Some subterranean ore deposits which are refractory to the standard alkaline lixiviant employing carbonate and/or bicarbonate ions as the leaching agent are more readily leached with an acid lixiviant employing sulfuric acid. However, in many cases such deposits contain significant quantities of carbonate materials such as calcite which may lead to excessive acid consumption as well as plugging by such precipitates as calcium sulfate. The present invention results from the discovery that uranium may be leached from the formation employing sulfate ion as the leaching agent at near neutral or alkaline pH conditions under which carbonate materials in the formation are not dissolved by the lixiviant. The leaching action of the sulfate lixiviant does not require the presence of carbonate ions although in some cases, particularly where employing a hypochlorite oxidant as described hereinafter, the leaching rate and/or ultimate uranium recovery may be increased by employing a carbonate leaching agent in combination with the sulfate. Reference herein to carbonate leaching agent is meant to include alkali metal bicarbonates as well as carbonates and mixtures of carbonate and bicarbonate ions.

In-situ leaching operations employing carbonate lixiviants commonly result in the presence of minor amounts of sulfate ions in the lixiviant due to oxidation of sulfides such as iron pyrite. Typically, the sulfate ion concentration in such cases may range from about 100 parts per million up to about 2000 parts per million. In the present invention, the injected fresh lixiviant contains a substantially higher concentration of an alkali metal sulfate and, except in the case where hypochlorite is employed as an oxidant, the sulfate is the predominant leaching agent in the lixiviant. Thus, if a carbonate leaching agent is also employed, it is present as a minor constituent.

As disclosed in the aforementioned application Ser. No. 928,676 by Habib and Vogt, the use of a hypochlorite oxidant in an alkaline lixiviant results in significant increases in leaching rate and uranium recovery for ores that are refractory in the presence of conventional oxidants such as hydrogen peroxide and sodium chlorate. The use of a sulfate leaching agent, either alone or in combination with carbonate, results in an even greater increase in the leaching rate. Further, even in the presence of a conventional oxidant such as hydrogen peroxide, the use of a sulfate leaching agent in accordance with the present invention results in a moderately higher leaching rate than that attained through the use of conventional carbonate lixiviants.

In experimental work carried out regarding the present invention, two general experimental procedures were followed. In one referred to herein as the "batch" technique, the experimental procedure involved the addition of 50 $cm^3$ of lixiviant to a container containing 10 grams of uranium ore. The container was then placed in a shaker where it was agitated at room temperature. After 3 hours of agitation, the lixiviant was withdrawn and filtered and the filtrate then analyzed for uranium by the colorimetric method. For each test, this identical procedure was followed on a second sample of the same ore with the exception that the agitation continued for a period of 24 hours. The uranium leached from the ore sample at the end of the 3-hour and 24-hour periods was then employed to calculate a first order rate constant in accordance with the following equation:

$$K=(LnC_0-LnC_1/t) \quad (1)$$

wherein K is the rate constant in $hours^{-1}$, $C_0$ is the uranium content of the ore sample after leaching for a first period, i.e. 3 hours, $C_1$ is the uranium content of the ore sample after leaching for a second period, i.e. 24 hours, and t is the elapsed time between the two leaching periods, i.e. 21 hours.

In a first suite of experiments, batch leaching tests were conducted on a number of ore samples of a composite ore obtained from the same core hole penetrating a subterranean uranium deposit. The ore contains uranium in the form of coffinite occurring as individual grains and aggregates of grains in a matrix of carbonaceous material. The matrix contains other minerals such as pyrite, apatite, anatase or rutile and chlorite. The carbonaceous material occurs in a poorly sorted sandstone consisting of detrital quartz, feldspar and rock fragments. Locally abundant kaolinite or chlorite, calcite and the carbonaceous material are the primary cementing agents.

The results of these tests, identified herein as runs 1, 2, and 3, are set forth in Table I. The lixiviant employed in run 1 contained 1 weight percent sodium hypochlorite and 0.21 weight percent sodium bicarbonate. The lixiviant employed in each of runs 2 and 3 contained sodium hypochlorite in the same concentration but was free of bicarbonate and contained sodium sulfate in a concentration of 5.0 weight percent. Run 3 also contained 3.0 weight percent sodium chloride. The second and third columns of Table I set forth the uranium concentration in the pregnant lixiviant expressed as parts per million $U_3O_8$ at the end of 3 hours and 24 hours, respectively. The fourth column sets forth the percentage of uranium leached from the sample at the end of the 24-period and the last column gives the rate constant, K, calculated in accordance with equation (1). As can be seen from examination of the data presented in Table I, the use of the sulfate lixiviant provided a greater uranium recovery and a higher rate constant than did the bicarbonate lixiviant. Further, run 3 indicates that the high chloride content in the sulfate lixiviant was not detrimental to the leaching process.

TABLE I

| | ppm $U_3O_8$ | | % $U_3O_8$ | |
|---|---|---|---|---|
| Run | 3 hr | 24 hr | leached | $K \times 10^{-3}$ |
| 1 | 14.5 | 47.2 | 19.9 | 9.8 |
| 2 | 15.6 | 61.8 | 26.0 | 15.5 |
| 3 | 16.7 | 63.1 | 26.6 | 15.7 |

A further set of experiments employing sulfate and carbonate lixiviants was carried out in employing a large batch testing procedure which was modified to more closely simulate the in-situ leaching mechanism. In this procedure, lixiviant was initially added to the container containing the ore sample and at time intervals throughout the test a portion of the lixiviant was withdrawn as pregnant lixiviant and fresh lixiviant then added and the leaching procedure continued. In one case, the lixiviant employed contained 0.2% sodium bicarbonate and 0.5 weight percent sodium hypochlorite. The pH of the lixiviant was 8.5. 1500 grams of uranium ore having a uranium concentration of 0.074 weight percent $U_3O_8$ was employed. The sulfate lixiviant was at a pH of 8.9 and contained 5.0 weight percent sodium sulfate and 0.5 weight percent sodium hypochlorite. 1000 grams of the same uranium ore as employed in the test of carbonate lixiviant was used in the sulfate batch test procedure.

The results of these large batch test experiments employing bicarbonate and sulfate lixiviants are set forth in Tables II and III, respectively. In each of Tables II and III, the first column sets forth the time in hours and the second and third columns set forth the amount of pregnant lixiviant removed from the container and the amount of fresh lixiviant added, respectively. The fourth column sets forth the amount of lixiviant remaining in the container at the conclusion of the removal and addition procedure. The fifth column sets forth the concentration of the uranium in parts per million of $U_3O_8$ in the lixiviant solution and the sixth column sets forth the corresponding amount of uranium in milligrams in the lixiviant. The seventh column gives the milligrams of $U_3O_8$ removed in the pregnant lixiviant and the eighth column gives the milligrams of $U_3O_8$ leached during the preceding time increment. The ninth column gives the percent of uranium leached during the preceding time increment and the last column the cumulative amount of uranium leached, both expressed as a percent of the original uranium content of the ore. From an examination of the data presented in Tables II and III, it can be seen that the sulfate lixiviant resulted in a greater uranium recovery than the carbonate lixiviant. In addition the sodium sulfate lixiviant produced a higher leaching rate than did the lixiviant containing sodium bicarbonate.

TABLE II

| Time, hrs | Volume, cc Removed | Volume, cc Added | Volume, cc Remaining | $U_3O_8$ Conc., ppm | $U_3O_8$ In sol., mg | $U_3O_8$ Removed, mg | $U_3O_8$ Leached, mg | $U_3O_8$ % Leached | $U_3O_8$ % Leached, cum. |
|---|---|---|---|---|---|---|---|---|---|
| 0 | — | 2000 | 2000 | — | — | — | — | — | — |
| 44 | 490 | 1100 | 2510 | 154 | 308 | 75.5 | 308 | 27.7 | 27.7 |
| 120 | 1050 | 1050 | 2510 | 149 | 374 | 156.5 | 141.5 | 12.7 | 40.4 |
| 170 | 1000 | 1000 | 2510 | 112.5 | 282.5 | 112.5 | 65 | 5.9 | 46.3 |
| 213 | 1275 | — | 2510 | 101.4 | 254.5 | 129.5 | 84.5 | 7.6 | 53.9 |
| 312 | 712 | — | 2035 | 73.7 | 150 | 52.5 | 25 | 2.3 | 56.2 |
| 492 | 1190 | 1200 | 2045 | 54.2 | 110.3 | 64.5 | 12.8 | 1.2 | 57.4 |
| 724 | 1390 | — | 655 | 41.7 | 85.3 | 58.0 | 39.5 | 3.6 | 61.0 |

TABLE III

| Time, hrs | Volume, cc Removed | Volume, cc Added | Volume, cc Remaining | $U_3O_8$ Conc., ppm | $U_3O_8$ In sol., mg | $U_3O_8$ Removed, mg | $U_3O_8$ Leached, mg | $U_3O_8$ % Leached | $U_3O_8$ % Leached, cum. |
|---|---|---|---|---|---|---|---|---|---|
| 0 | — | 1330 | 1330 | — | — | — | — | — | — |
| 72 | 700 | 970 | 1600 | 167.5 | 222.8 | 162.5 | 222.8 | 30.1 | 30.1 |
| 140 | 670 | 770 | 1700 | 126.2 | 201.9 | 84.6 | 141.6 | 19.1 | 49.2 |
| 260 | 935 | 1915 | 2680 | 115.0 | 195.5 | 107.5 | 78.2 | 10.6 | 59.8 |
| 600 | 1590 | — | 1090 | 52.5 | 140.7 | 83.5 | 52.7 | 7.1 | 66.9 |

The lixiviant employed in accordance with the present invention may contain both carbonate and sulfate complexing agent. The use of the carbonate-sulfate lixiviant results in somewhat higher leaching rates than are generally attained through the use of lixiviants containing either the carbonate or sulfate complexing agent alone. These increased leaching rates are indicated by experimental laboratory work using the standard "batch" procedure described previously. The lixiviants employed contained sodium hypochlorite or hydrogen peroxide and sodium bicarbonate or sodium sulfate or mixtures of sodium bicarbonate and sodium sulfate. The results of this comparative experimental work are set forth in Table IV wherein the second, third, fourth and fifth columns define the lixiviant composition in terms of the weight percent of sodium hypochlorite, hydrogen peroxide, sodium bicarbonate, and sodium sulfate, respectively, and the last column sets forth the first order rate constant calculated in accordance with equation (1). In Table IV, runs 7, 12, 13, 17, 20 and 21 are control experiments carried out without the presence of sodium sulfate. The remaining runs illustrate the leaching rate employing sodium sulfate in concentrations ranging from 0.3 up to 5.0 weight percent. In runs, 7, 12, 17, and 20–23, the lixiviant had a pH of 8.3. In the other ten runs, the lixiviant had a pH of 9.0. In each case, the lixiviant was employed in an amount of 50 $cm^3$ to leach 10 grams of the composite ore described previously.

TABLE IV

| Run | Lixiviant Composition, % NaOCl | $H_2O$ | $NaHCO_3$ | $Na_2SO_4$ | $K \times 10^{-3}$ |
|---|---|---|---|---|---|
| 7 | 1.0 | — | .4 | — | 24.3 |
| 8 | 1.0 | — | .4 | .3 | 24.3 |
| 9 | 1.0 | — | .4 | .8 | 26.5 |

TABLE IV-continued

| Run | Lixiviant Composition, % NaOCl | $H_2O$ | $NaHCO_3$ | $Na_2SO_4$ | $K \times 10^{-3}$ |
|---|---|---|---|---|---|
| 10 | 1.0 | — | .4 | 2.0 | 25.4 |
| 11 | 1.0 | — | .4 | 5.0 | 27.3 |
| 12 | .5 | — | .2 | — | 2.3 |
| 13 | .5 | — | .4 | — | 13.0 |
| 14 | .5 | — | .4 | .3 | 18.5 |
| 15 | .5 | — | .4 | .8 | 18.4 |
| 16 | .5 | — | .4 | 2.0 | 21.4 |
| 17 | .2 | — | .2 | — | 9.5 |
| 18 | .2 | — | .4 | — | 8.0 |
| 19 | .2 | — | .4 | .3 | 11.6 |
| 20 | — | .21 | .21 | — | 1.8 |
| 21 | — | .21 | .4 | — | 1.8 |
| 22 | — | .21 | .4 | .3 | 1.9 |
| 23 | — | .21 | .4 | 1.5 | 2.0 |

As can be seen from an examination of the data presented, the presence of relatively small amounts of sodium sulfate significantly accelerates the leaching rates for hypochlorite concentrations of 0.2 and 0.5 percent. At hypochlorite concentrations of 1.0 percent, where the leaching rate was already high in the absence of sulfate ion, relatively high sodium sulfate concentrations were required to further increase the leaching rate. Where the less active oxidant, hydrogen peroxide, was employed, a relatively large amount of sodium sulfate was required to effect a modest increase in the leaching rate.

The alkali metal sulfate may be employed in any suitable concentration depending upon the uranium content of the subterranean uranium deposit and the leaching rate achieved by the lixiviant in the deposit. Where the sulfate is the sole complexing agent in the lixiviant, it usually will be preferred to employ the alkali metal sulfate in a concentration within the range of 2 to 7 weight percent. Where carbonate or bicarbonate is also present in the lixiviant, it usually will be preferred to employ the alkali metal sulfate in a somewhat lower concentration within the range of 0.5 to 5 weight percent. Where moderately active acidizing agents such as air, oxygen, hydrogen peroxide, or sodium chlorate are employed, the alkali metal sulfate is the predominant leaching agent as indicated previously. If a carbonate leaching agent is also employed, it is present in a lower concentration than the sulfate. Preferably, the concentration ratio of the alkali metal sulfate to the alkali metal carbonate (or bicarbonate) is at least 3. Where an alkali metal hypochlorite is employed as an oxidant, the alkali metal sulfate need only be present as a minor constituent in a sulfate-carbonate leaching system to effect a significant increase in the leaching rate, particularly at the lower hypochlorite concentrations. Usually, however, it will be preferred to employ the sulfate as the predominant leaching agent and where carbonate is also present to provide a concentration ratio of sulfate to carbonate of at least 2.

As noted previously, the pH of the injected sulfate lixiviant is at least 6.0 in order to avoid reaction with carbonate materials within the formation. Where an alkali metal hypochlorite is employed as an oxidizing agent, the pH should be at least 7.5 in order to avoid decomposition of the hypochlorite. The hypochlorite oxidant may be employed in any suitable concentration, as disclosed in the aforementioned application Ser. No. 928,676, but usually will be present in a concentration of at least 0.01 weight percent and preferably within the range of about 0.1–1.0 weight percent. Normally the pH of the lixiviant will fall within the range of 8–10.

The present invention may be carried out utilizing injection and production systems as defined by any suitable well arrangement. One well arrangement suitable for use in carrying out the invention is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically the spacing between injection and production wells will be on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

I claim:

1. In the recovery of uranium from a subterranean uranium-containing deposit penetrated by injection and production systems, the method comprising:

(a) introducing into said deposit via said injection system an aqueous lixiviant having a pH of at least 6.0 and containing a leaching agent comprised predominantly of an alkali metal sulfate, (b) displacing said lixiviant through said subterranean deposit to solubilize uranium therein, (c) producing pregnant lixiviant containing uranium from said production system, and (d) treating said pregnant lixiviant to recover uranium therefrom.

2. The method of claim 1 wherein said alkali metal sulfate is present in said lixiviant in a concentration of at least 2.0 weight percent.

3. The method of claim 1 wherein said lixiviant has a pH within the range of 8–10.

4. The method of claim 1 wherein the leaching agent in said lixiviant comprises a minor amount of an alkali metal carbonate or bicarbonate.

5. The method of claim 4 wherein the ratio of the concentration of said alkali metal sulfate to the concentration of said alkali metal carbonate or bicarbonate in said lixiviant is at least 3.

6. The method of claim 1 wherein said alkali metal hypochlorite is present in said lixiviant in a concentration within the range of 0.1–1.0 weight percent.

7. The method of claim 1 wherein the pH of said lixiviant is within the range of 8–10.

8. In the recovery of uranium from a subterranean uranium-containing deposit penetrated by injection and production systems, the method comprising:

(a) introducing into said deposit via said injection system an aqueous lixiviant having a pH of at least 7.5 and containing an alkali metal sulfate leaching agent and an alkali metal hypochlorite oxidizing agent, (b) displacing said lixiviant through said subterranean deposit to solubilize uranium therein, (c) producing pregnant lixiviant containing uranium from said production system, and (d) treating said pregnant lixiviant to recover uranium therefrom.

9. The method of claim 8 wherein said lixiviant also contains an alkali metal carbonate or bicarbonate.

10. The method of claim 9 wherein the concentration of said alkali metal sulfate in said lixiviant is greater than the concentration of said alkali metal carbonate or bicarbonate.

11. The method of claim 10 wherein the ratio of the concentration of said alkali metal sulfate to the concentration of said alkali metal carbonate or bicarbonate is at least 2.

* * * * *